US007740601B2

(12) United States Patent
Wu

(10) Patent No.: US 7,740,601 B2
(45) Date of Patent: Jun. 22, 2010

(54) NOTEBOOK COMPUTER WITH LOW-FREQUENCY ELECTROTHERAPY

(75) Inventor: Cheng-Yu Wu, Taipei (TW)

(73) Assignee: Inventec Corporation, Taipei (TW)

( * ) Notice: Subject to any disclaimer, the term of this patent is extended or adjusted under 35 U.S.C. 154(b) by 787 days.

(21) Appl. No.: 11/710,717

(22) Filed: Feb. 26, 2007

(65) Prior Publication Data

US 2008/0208086 A1 Aug. 28, 2008

(51) Int. Cl.
*A61H 1/00* (2006.01)

(52) U.S. Cl. ..... 601/15; 601/21; 607/2

(58) Field of Classification Search ..... 601/15, 601/18, 20, 21, 41, 44, 48; 607/2, 42, 48, 607/59, 60, 67, 68, 72
See application file for complete search history.

(56) References Cited

U.S. PATENT DOCUMENTS

| | | | | |
|---|---|---|---|---|
| 5,285,781 | A * | 2/1994 | Brodard | 607/59 |
| 5,938,690 | A * | 8/1999 | Law et al. | 607/46 |
| 6,052,624 | A * | 4/2000 | Mann | 607/46 |
| 7,318,790 | B2 * | 1/2008 | Chuang et al. | 601/33 |

* cited by examiner

*Primary Examiner*—Quang D Thanh
(74) *Attorney, Agent, or Firm*—Morris, Manning & Martin LLP; Tim Tingkang Xia

(57) ABSTRACT

A notebook computer with low-frequency electrotherapy is provided. A low-frequency massage device including a pulse generator and massage pads is disposed in the mainframe of the notebook computer. The pulse generator is electrically coupled to a power supply of the mainframe, which supplies power for the pulse generator, and the massage pads are selectively connected to a low-frequency generator, such that while operating the notebook computer, a user attaches the massage pads on suitable parts of his/her body to enjoy the low frequency electrotherapy massage.

15 Claims, 6 Drawing Sheets

NOTEBOOK COMPUTER WITH LOW-FREQUENCY ELECTROTHERAPY

BACKGROUND OF THE INVENTION

1. Field of Invention

The present invention relates to a notebook computer, and more particularly to a notebook computer which provides low-frequency electrotherapy massage for users.

2. Related Art

Gradually popularized notebook computers are used not only for common word processing and Internet, but also for multi-media entertainments, such as playing videos and games. That is to say, a user may operate a notebook for a long time, and often use the notebook computer for both working and entertaining for more than ten hours per day. Such long-time operation usually causes neck and shoulder pain and excessively high load to elbows and wrists. The user cannot fully relax himself/herself after leaving the notebook computer to have a rest for only several minutes.

Although massage devices, such as massage chairs and massagers, may provide physical stimulation for the user to achieve muscle-relaxing effect, such device are all mechanical devices, have a large volume, and cannot be carried conveniently. Moreover, generally, in a situation for computer operation, it is impossible for the user to use such vibrating mechanical massage devices.

In addition, a low-frequency electrotherapy device is used to stimulate nerves and acupoints, promote blood circulation, and especially give massage to the user to relieve shoulder and muscle soreness. The low-frequency electrotherapy device is an independent module, and contacts with the predetermined parts of the body of the user through two low-frequency therapeutic pads or massage pads. The user may control the low-frequency electrotherapy device to output pulse currents with different intensities to the massage pads by controlling the mainframe, thereby producing different massaging and stimulating effects.

SUMMARY OF THE INVENTION

In order to solve the aforementioned problems, the present invention provides a notebook computer with low-frequency electrotherapy, such that the user may activate low-frequency electrotherapy function when the notebook computer is shut down and may simultaneously use the notebook computer and enjoy the low-frequency electrotherapy function after the notebook computer is enabled.

The notebook computer with the low-frequency electrotherapy provided by the present invention comprises a keyboard, a control unit, a power supply unit, a pulse generator, and massage pads or conductive plates having low-frequency electrotherapy, wherein the user outputs a start signal and a stop signal by operating the keyboard. The control unit is electrically coupled to the keyboard to receive the start signal or the stop signal, and output an enable signal or a disable signal according to the start signal or the stop signal. The pulse generator is electrically coupled to the control unit and the power supply unit, so as to determine whether or not to receive an operating voltage according to the enable signal or the disable signal, and generate a pulse current when receiving the operating voltage and output the pulse current through the massage pads or the conductive plates. The user attaches the massage pads on predetermined parts for electrotherapy or lays the wrist on the conductive plates, so as to enjoy the electrotherapy massage.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given herein below for illustration only, and thus is not limitative of the present invention, and wherein.

DETAILED DESCRIPTION OF THE INVENTION

The specific features and the advantages of the present invention are described in detail in the following embodiments, and may enable those skilled in the art to understand the technical contents of the present invention and implement them. The relevant objects and the advantages of the present invention can be easily understood by those skilled in the art based on the disclosure of the specification, the claims, and the drawings.

Figure 1:
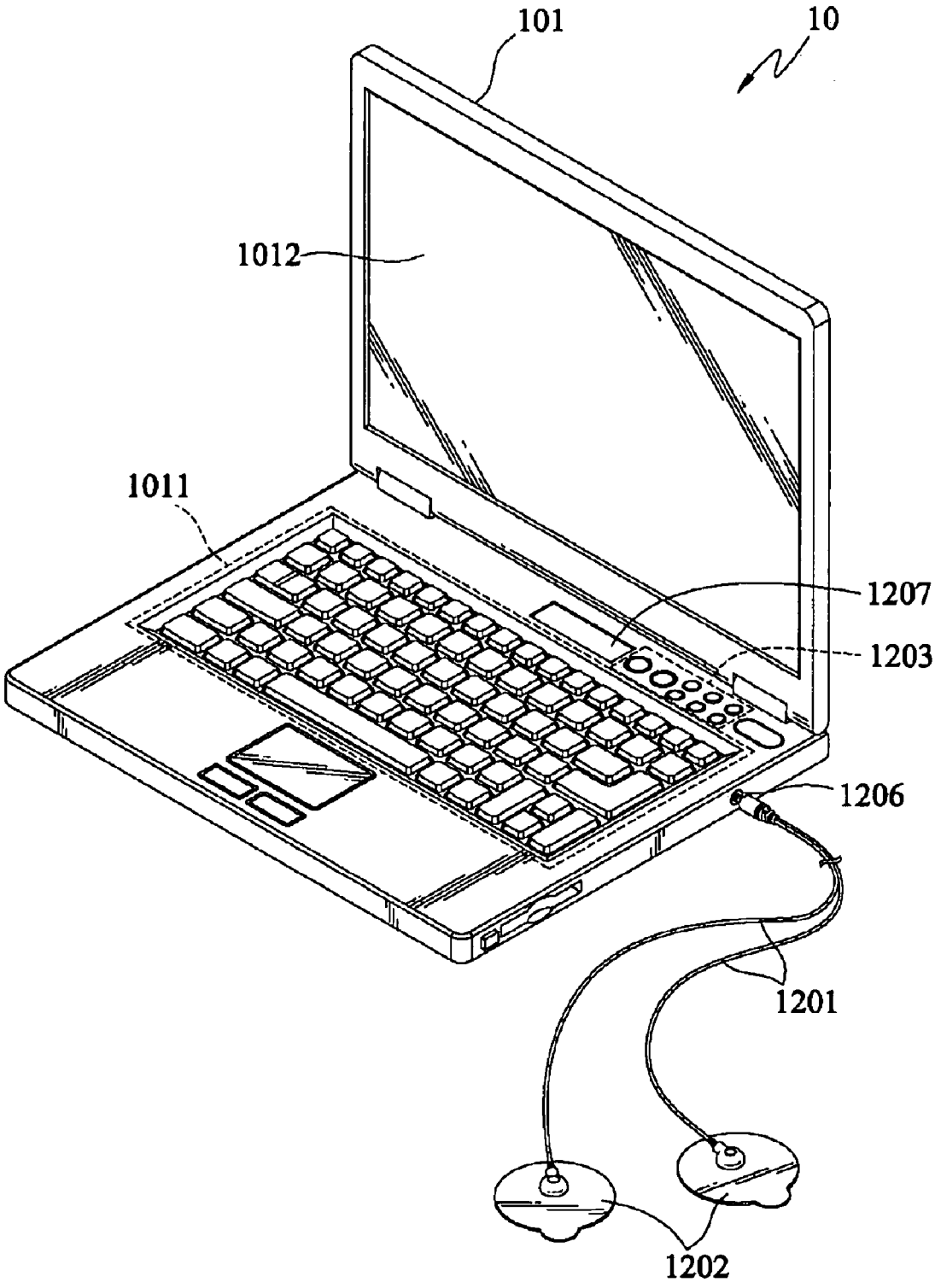
FIG. 1 is a schematic view of a first preferred embodiment according to the present invention.
Figure 2:
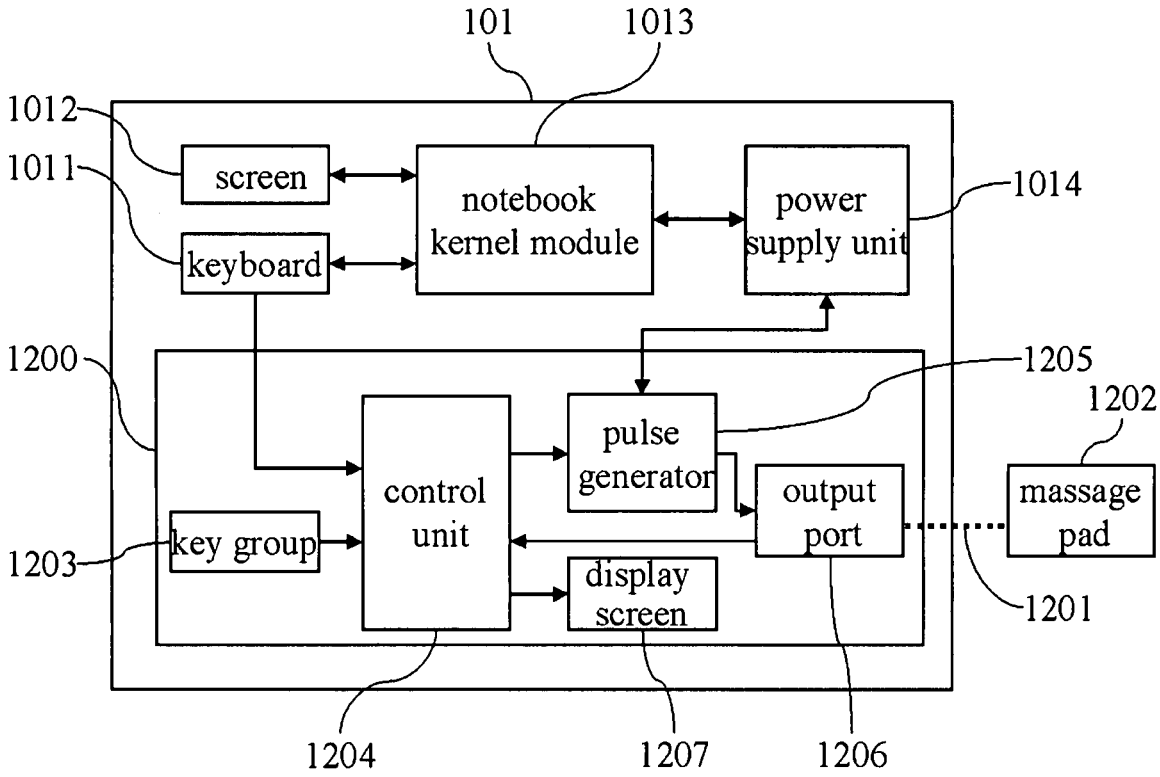
FIG. 2 is a system architecture view of the first preferred embodiment according to the present invention.

Referring to FIGS. 1 and 2, a first preferred embodiment of the present invention is shown. FIG. 1 is a schematic view of the notebook computer with low-frequency electrotherapy according to the present invention. FIG. 2 is a system architecture view of the notebook computer with low-frequency electrotherapy according to the present invention.

In this embodiment, the notebook computer 10 may enable a user to use it and enjoy low-frequency electrotherapy simultaneously. The notebook computer 10 includes a mainframe 101 and at least one low-frequency massage pad 1202, wherein, for sake of convenience in illustration, the number of the massage pads 1202 is determined to be two. The massage pads 1202 are selectively connected to the mainframe 101 and can be pulled out when they are not used. In addition, a conductor line 1201 further extends from the massage pads 1202, respectively, such that the massage pads 1202 may be connected to the mainframe 101 and the user may conveniently attach the massage pads 1202 on the parts of the body through the extending length of the conductor lines 1201.

The mainframe 101 includes a keyboard 1011, a liquid crystal screen 1012, a notebook computer kernel module 1013, and a power supply unit 1014 for outputting an operating voltage, wherein the keyboard 1011 and the liquid crystal screen 1012 are respectively an input interface and an output interface for electronic data processing. For example, when the mainframe 101 is running, the keyboard 1011 generates and outputs a start signal and a stop signal according to the operation of the user, and the liquid crystal screen 1012 is used to display function options of the low-frequency electrotherapy.

The notebook kernel module 1013 includes components required by the notebook computer to execute computer functions, such as a central processing unit (CPU) and a random access memory (RAM), wherein the CPU is electrically coupled to the keyboard 1011, the liquid crystal screen 1012, and the power supply unit 1014, so as to process the signals output by the keyboard 1011 and the liquid crystal screen 1012, and control the power supply of the power supply unit 1014.

The power supply unit 1014 is used to output an operating voltage, such as a battery, but it is not limited to the battery. Besides the CPU, the power supply unit 1014 is also electrically coupled to the low-frequency electrotherapy device 1200, so as to provide the necessary power for the two.

The low-frequency electrotherapy device 1200 includes a key group 1203, a control unit 1204, a pulse generator 1205, an output port 1206, and a display screen 1207, wherein the key group 1203, the pulse generator 1205, the output port 1206, and the display screen 1207 are electrically coupled to the control unit 1204. The key group 1203 and the display screen 1207 are respectively the input interface and the output interface of the low-frequency electrotherapy. For example, when the mainframe 101 is shut off, the user sets the low frequency through the key group 1203, and the display screen 1207 is used to display the function options of the low-frequency electrotherapy.

The control unit 1204 is further electrically coupled to the keyboard 1011 to control the pulse generator 1205. The control unit 1204 receives the start signal or the stop signal and outputs an enable signal or a disable signal to the pulse generator 1205 according to the start signal or the stop signal. The pulse generator 1205 determines whether to receive the operating voltage according to the enable signal or the disable signal, and generates a pulse current when receiving the operating voltage.

After the pulse current is generated, the pulse generator 1205 outputs the pulse current to the massage pads 1202 through the output port 1206. The control unit 1204 detects whether the output port 1206 is connected to the massage pads 1202. If it is detected that the output port 1206 is connected to the massage pads 1202, the control unit 1204 starts the pulse generator 1205 automatically, or the control unit 1204 receives an instruction from the key group 1203, and starts/controls the pulse generator 1205 according to the instruction. Furthermore, since the pulse generator 1205 and the power supply unit 1014 are electrically coupled, the power supply unit 1014 provides the necessary power for the pulse generator 1205 to generate the pulse current.

The output port 1206 serves as a medium for electrically connecting the massage pads 1202 and the mainframe 101, and the output port 1206 is also connected to the massage pads 1202 through the conductor lines 1201. The output port 1206 outputs the pulse current of the pulse generator 1205 to the massage pads 1202, and the massage pads 1202 or the conductor lines 1201 can be pulled out from the output port 1206 when the user is not using the low-frequency electrotherapy massage. The massage pads 1202 have conductive and adhesive effects and may be attached on the body of the user, and the pulse current is transmitted to the body of the user through the massage pads 1202 after the pulse current is output.

The key group 1203 has multiple control keys, such as the control keys A1 to A5. The control key A1 is used to start/stop the low-frequency electrotherapy, the control key A2 is used to select different massage modes and pulse modes, the control key A3 is used to enhance the current intensity, the control key A4 is used to reduce the current intensity, and the control key A5 is used to set the massage time. The user starts or sets the low-frequency electrotherapy device 1200 through the key group 1203, and at this time, the key group 1203 outputs an instruction to the control unit 1204.

The display screen 1207 displays the information set through the key group 1203, such as the massage mode, the current intensity and the massage time, and also displays the power supply state of the power supply unit 1014, such as the remaining electric power.

According to an embodiment of the present invention, when the user wants to use the low-frequency electrotherapy, the user connects one end of the conductor line 1201 to the output port 1206 and the other end to the massage pad 1202, and then attaches the massage pads 1202 on suitable parts of the user's body. At this time, if the mainframe 101 is running, the user uses a specific key combination of the keyboard 1011, such as Ctrl+F1, to start the low-frequency electrotherapy device 1200; on the contrary, when the mainframe 101 is shut off, the user may press the control key A1 in the key group 1203 to start the low-frequency electrotherapy device 1200.

At the mainframe 101, the electric power for the operation of the low-frequency electrotherapy device 1200 is provided by the power supply unit 1014 of the mainframe 101. Once the low-frequency electrotherapy device 1200 is started, the user sets the desired massage mode or the current intensity by using the other control keys A2 to A5 of the key group 1203 or existing specific key combinations of the keyboard 1011, such as Ctrl+F2, and the current setting status can be known through the display screen 1207. It should be noted that the start key is not limited to the control key A1 in the key group or the key combination Ctrl+F1 in the keyboard 1011.

In addition, when operating the mainframe 101, the user uses the wrists to apply force frequently and sometimes suffers the problem of overexertion. Therefore, the low-frequency electrotherapy can be performed on the wrist-placing area when the user is operating the mainframe 101, so as to avoid the user suffering from carpal tunnel syndrome. Thus, a second preferred embodiment is further disclosed in the present invention.

Figure 3:
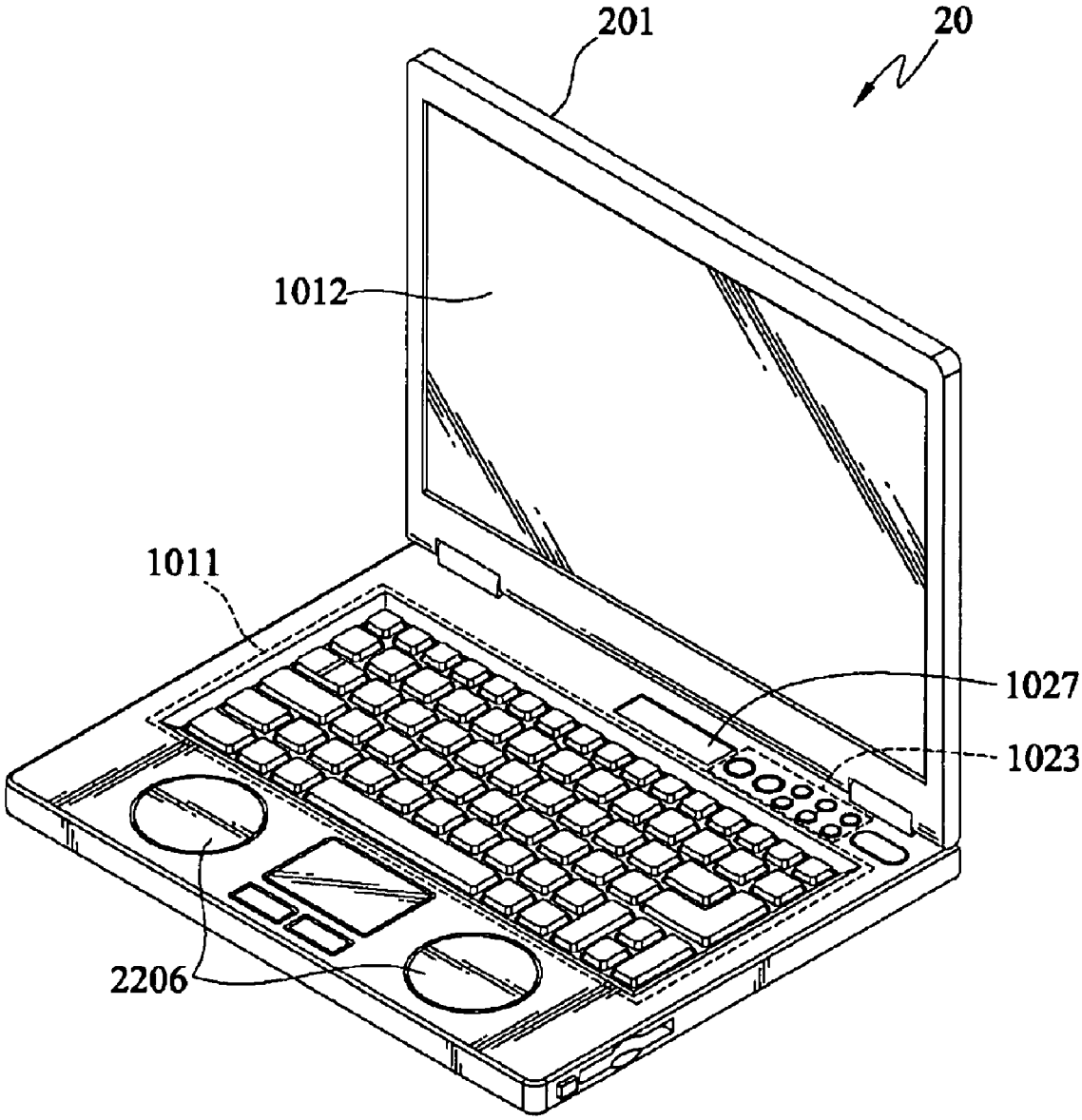
FIG. 3 is a schematic view of a second preferred embodiment according to the present invention.
Figure 4:
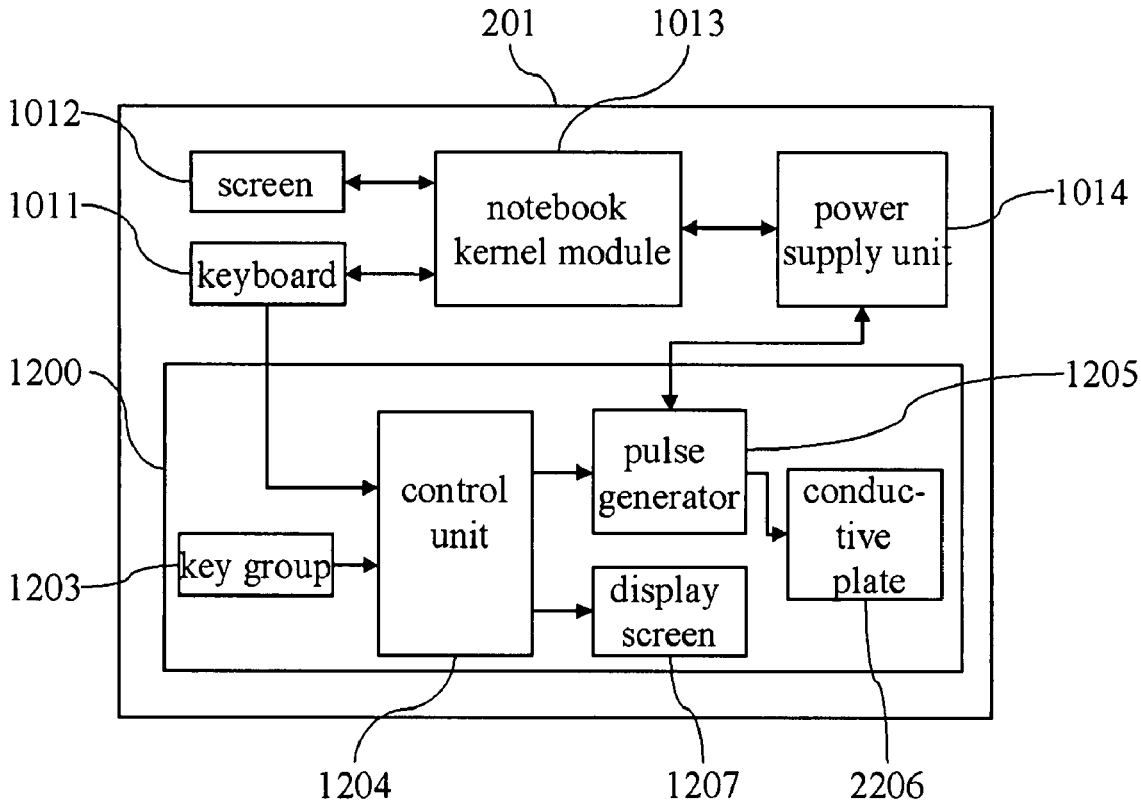
FIG. 4 is a system architecture view of the second preferred embodiment according to the present invention.

Referring to FIGS. 3 and 4, a second preferred embodiment of the present invention is shown. FIG. 3 is a schematic view of the notebook computer according to another preferred embodiment of the present invention, and FIG. 4 is a system architecture view corresponding to FIG. 3.

As shown in FIG. 3, the mainframe 201 of the notebook computer 20 includes conductive plates 2206 disposed on the wrist-placing area of the mainframe 201, wherein the conductive plates 2206 are used to not only support the wrists of the user to operate the keyboard 1011 conveniently, but also have the function of conducting the pulse current. The user can start the conductive function of the conductive plates 2206 by using the key group 1027 or the existing specific key combination of the keyboard 1011.

At this time, after placing the wrists on the conductive plates 2206, the user may operates the notebook computer and enjoy the electrotherapy to the wrists simultaneously. As shown in FIG. 4, in this embodiment, except the conductive plates 2206 of the mainframe 201 which replace the output port 1206, the conductor lines 1201, and the massage pads 1202 of the mainframe 101 in the aforementioned embodiment, other components of the mainframe 201 and the functions thereof are the same as those in the aforementioned embodiment and will not be described any more.

The user may enjoy the electrotherapy massage on suitable parts of the body and the wrists in the wrist-placing area simultaneously, so as to enhance the low-frequency electrotherapy effect. Therefore, a third preferred embodiment is further disclosed in the present invention.

Figure 5:
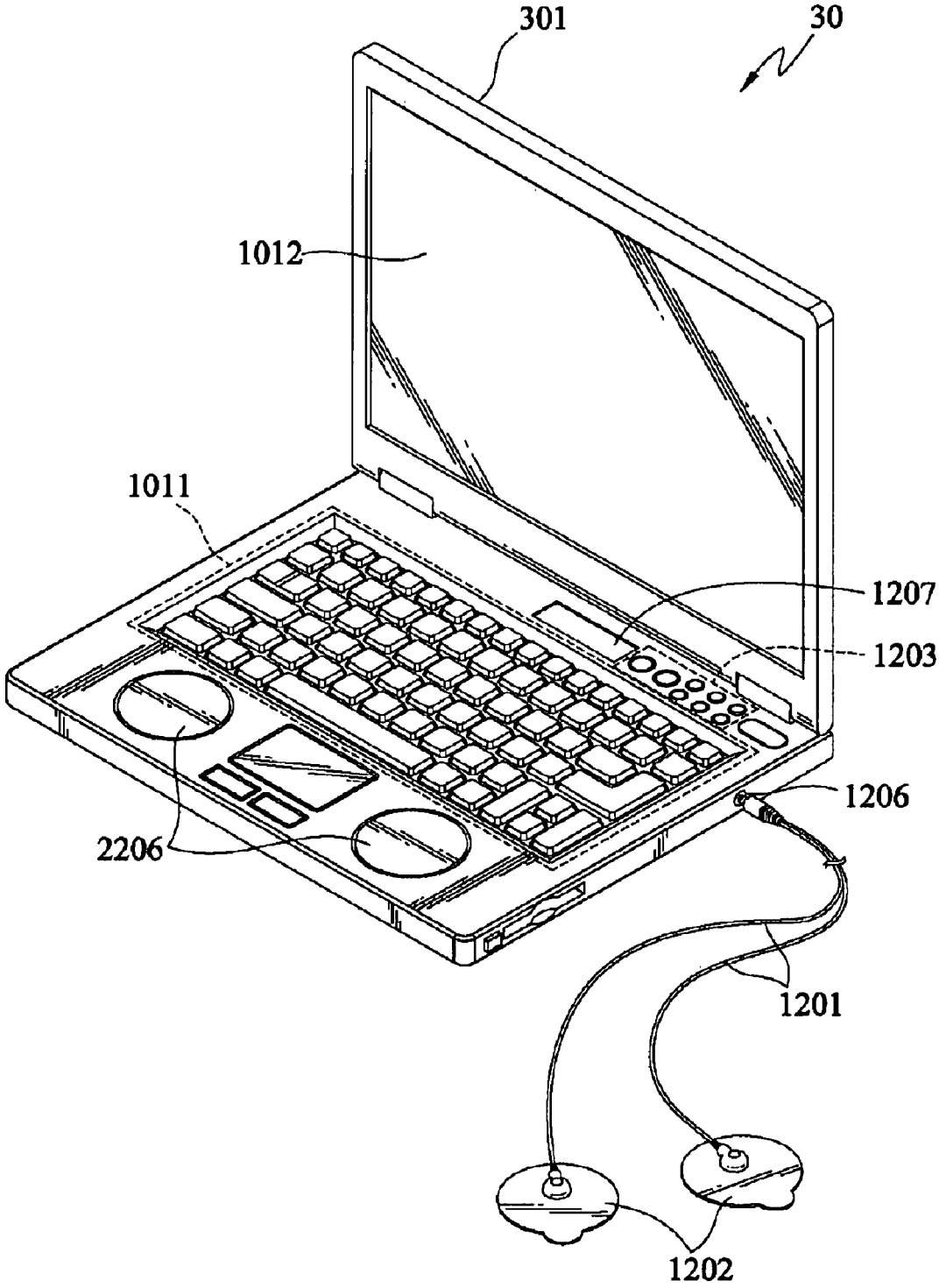
FIG. 5 is a schematic view of a third preferred embodiment according to the present invention.
Figure 6:
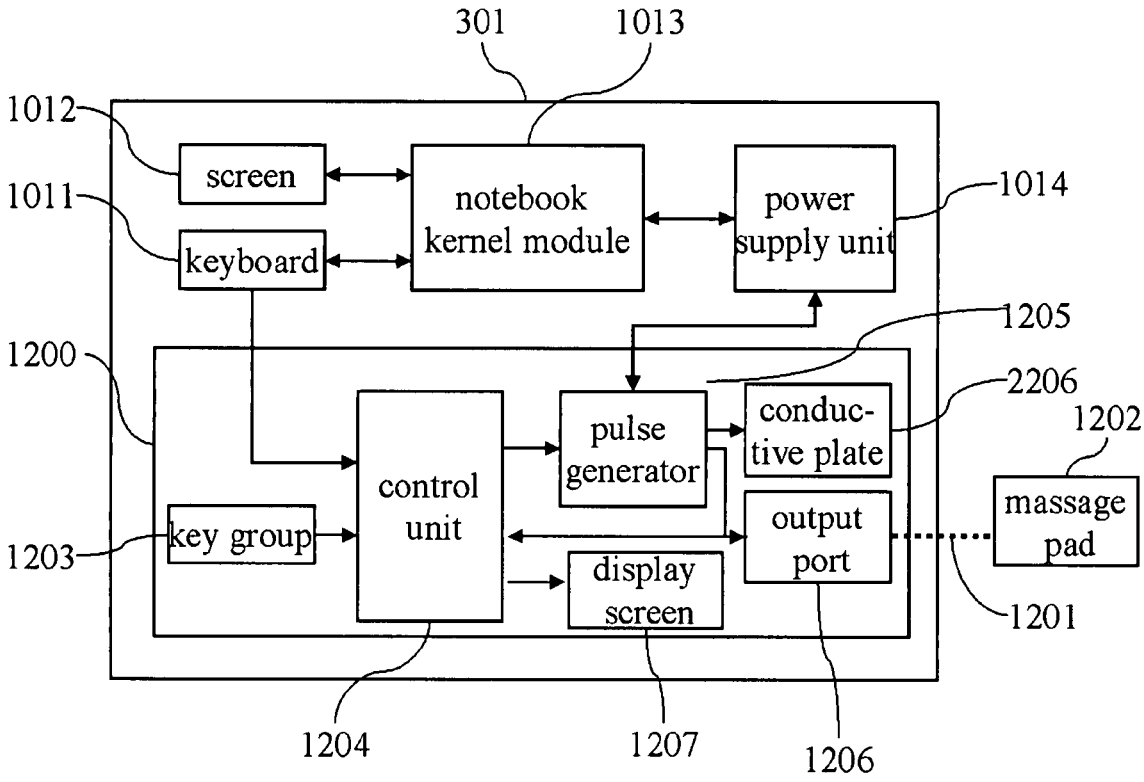
FIG. 6 is a system architecture view of the third preferred embodiment according to the present invention.

Referring to FIGS. 5 and 6, a third preferred embodiment of the present invention is shown. FIG. 5 is a schematic view of the notebook computer according to another preferred embodiment of the present invention, and FIG. 6 is a system architecture view corresponding to FIG. 5.

As shown in FIG. 5, the mainframe 301 of the notebook computer 30 includes the output port 1206, the conductor lines 1201, and the massage pads 1202 in the first preferred embodiment, and further includes the conductive plates 2206 in the second preferred embodiment. According to this embodiment, the user may enjoy the electrotherapy massage while operating the keyboard 1011 through placing the hands on the conductive plates 2206. Meanwhile, the user attaches the massage pads 1202 on the suitable parts of the body to enjoy the electrotherapy massage. Additionally, the user controls the pulse currents of the conductive plates 2206 and the massage pads 1202 respectively by using the key group 1203 or the existing specific key combinations of the keyboard 1011. As shown in FIG. 6, the mainframe 301 in this embodiment includes the components in the first and second embodiments, and the components of the mainframe 301 and the functions thereof are the same as those of the mainframes 101 and 201, and will not be described herein any more.

Furthermore, the mainframes 101, 201, and 301 employ the manner of touching and pressing keys as the input mode. However, as for the mainframes 101, 201, and 301, the user may touch the liquid crystal screen 1012 to send an instruction or input the data.

The low-frequency electrotherapy device and the notebook computer are integrated in the present invention. The notebook computer directly supplies power for the massage pads or the conductive plates of the low-frequency electrotherapy. The user may start the massage pads or the conductive pads at any time and select the desired massage mode or the pulse mode conveniently by using the key group in the notebook computer or the operation of software. Furthermore, the user may use the notebook computer and enjoy the low-frequency electrotherapy simultaneously, so as to eliminate the discomfort caused by the long-time operation of the notebook computer. In this manner, not only people become more willing to use the low-frequency electrotherapy, but also the value of the product is enhanced. In another aspect, when the user needs not to use the low-frequency electrotherapy device, the user may pull the massage pads from the output port, so as to occupy less space.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A notebook computer with low-frequency electrotherapy, comprising:

a keyboard, for generating and outputting one of a start signal and a stop signal according to operation of a user;

a control unit, electrically coupled to the keyboard, for receiving the start signal or the stop signal and outputting an enable signal or a disable signal according to the start signal or the stop signal;

a power supply unit, for outputting an operating voltage;

a pulse generator, electrically coupled to the power supply unit and the control unit, for determining whether or not to receive the operating voltage according to the enable signal or the disable signal, generating a pulse current when receiving the operating voltage, and outputting the pulse current; and at least one massage pad, electrically coupled to the pulse generator and adapted to be attached on body of the user, for receiving and outputting the pulse current.

2. The notebook computer with low-frequency electrotherapy as claimed in claim 1, further comprising a key group for setting the low-frequency electrotherapy function when the notebook computer is shut off.

3. The notebook computer with low-frequency electrotherapy as claimed in claim 1, further comprising a display screen electrically coupled to the control unit, for displaying function options of the low-frequency electrotherapy when the notebook computer is shut off.

4. The notebook computer with low-frequency electrotherapy as claimed in claim 1, further comprising a central processing unit (CPU) electrically coupled to the power supply unit and the keyboard, for processing the start signal or the stop signal output from the keyboard and controlling power supply of the power supply unit.

5. The notebook computer with low-frequency electrotherapy as claimed in claim 4, further comprising a liquid crystal screen electrically coupled to the CPU, for displaying function options of the low-frequency electrotherapy after the notebook computer is enabled.

6. A notebook computer with low-frequency electrotherapy, comprising:

a keyboard, for generating and outputting one of a start signal and a stop signal according to operation of a user;

a control unit, electrically coupled to the keyboard, for receiving the start signal or the stop signal and outputting an enable signal or a disable signal according to the start signal or the stop signal;

a power supply unit, for outputting an operating voltage;

a pulse generator, electrically coupled to the power supply unit and the control unit, for determining whether or not to receive the operating voltage according to the enable signal or the disable signal, generating a pulse current when receiving the operating voltage, and outputting the pulse current; and at least one conductive plate, disposed in a wrist-placing area of the notebook computer, for receiving and outputting the pulse current.

7. The notebook computer with low-frequency electrotherapy as claimed in claim 6, further comprising a key group for setting the low-frequency electrotherapy when the notebook computer is shut off.

8. The notebook computer with low-frequency electrotherapy as claimed in claim 6, further comprising a display screen electrically coupled to the control unit, for displaying function options of the low-frequency electrotherapy when the notebook computer is shut off.

9. The notebook computer with low-frequency electrotherapy as claimed in claim 6, further comprising a central processing unit (CPU) electrically coupled to the power supply unit and the keyboard, for processing the start signal or the stop signal output from the keyboard and controlling power supply of the power supply unit.

10. The notebook computer with low-frequency electrotherapy as claimed in claim 9, further comprising a liquid crystal screen electrically coupled to the CPU, for displaying function options of the low-frequency electrotherapy when the notebook computer is running.

11. A notebook computer with low-frequency electrotherapy, comprising:

a keyboard, for generating and outputting one of a start signal and a stop signal according to operation of a user;

a control unit, electrically coupled to the keyboard, for receiving the start signal or the stop signal and outputting an enable signal or a disable signal according to the start signal or the stop signal;

a power supply unit, for outputting an operating voltage;

a pulse generator, electrically coupled to the power supply unit and the control unit, for determining whether or not to receive the operating voltage according to the enable signal or the disable signal, generating a pulse current when receiving the operating voltage, and outputting the pulse current;

at least one conductive plate, disposed in a wrist-placing area of the notebook computer, for receiving and outputting the pulse current; and at least one massage pad, electrically coupled to the pulse generator and adapted to be attached on body of the user, for receiving and outputting the pulse current.

12. The notebook computer with low-frequency electrotherapy as claimed in claim 11, further comprising a key group for setting the low-frequency electrotherapy when the notebook computer is shut off.

13. The notebook computer with low-frequency electrotherapy as claimed in claim 11, further comprising a display screen electrically coupled to the control unit, for displaying function options of the low-frequency electrotherapy when the notebook computer is shut off.

14. The notebook computer with low-frequency electrotherapy as claimed in claim 11, further comprising a central processing unit (CPU) electrically coupled to the power supply unit and the keyboard, for processing the start signal or the stop signal output from the keyboard and controlling power supply of the power supply unit.

15. The notebook computer with low-frequency electrotherapy as claimed in claim 14, further comprising a liquid crystal screen electrically coupled to the CPU, for displaying function options of the low-frequency electrotherapy when the notebook computer is running.

* * * * *